US005452533A

United States Patent [19]

Bentley

[11] Patent Number: 5,452,533

[45] Date of Patent: Sep. 26, 1995

[54] MAGAZINE LOADED PUMP ACTION SHOTGUN

[76] Inventor: James K. Bentley, 29100 N. Lower Valley Rd., Tehachapi, Calif. 93561

[21] Appl. No.: 312,278

[22] Filed: Sep. 26, 1994

[51] Int. Cl.[6] ..... F41C 7/02

[52] U.S. Cl. ..... 42/17

[58] Field of Search ..... 42/17, 18, 19, 42/21, 22

[56] References Cited

U.S. PATENT DOCUMENTS

| | | | |
|---|---|---|---|
| 4,864,758 | 9/1989 | Crossman | 42/18 |
| 4,867,039 | 9/1989 | Dobbins | 89/127 |
| 4,930,399 | 6/1990 | Trevor, Jr. | 89/191.02 |
| 5,056,252 | 10/1991 | Velezis | 42/50 |

*Primary Examiner*—Charles T. Jordan

*Assistant Examiner*—Christopher K. Montgomery

*Attorney, Agent, or Firm*—Charles C. Logan, II

[57] ABSTRACT

A pump action shotgun that has been modified to accept a shotgun shell magazine that can be quickly and easily attached or removed. A shotgun shell loading port is formed in the bottom surface of the existing magazine tube adjacent its rear end. A magazine adapter is aligned with the shotgun shell loading port and secured to the bottom surface of the magazine. The magazine adapter has front and rear latch mechanism for securing the shotgun shell magazine. The existing magazine spring is removed from the magazine tube and a compressible subgroup assembly is inserted in its place. A transversely extending screw secures the forearm of the shotgun to the front end of the subgroup assembly so that they reciprocate as a single unit. An elongated slot is cut in the top surface of the existing magazine tube and the aforementioned screw passes therethrough. The bottom surface of the forearm is relieved adjacent its rear end so that it can clear the magazine adapter structure.

6 Claims, 2 Drawing Sheets

MAGAZINE LOADED PUMP ACTION SHOTGUN

BACKGROUND OF THE INVENTION

The invention relates to shotguns and more specifically to pump action shotguns.

Presently pump action shotguns have structure which restricts the number of shotgun shells that can be loaded in its magazine tube to five shells. When all five shells have been fired, it is necessary to turn the shotgun over and physically load one shell at a time into the magazine tube. This is an unreasonable delay when the weapon is in the hands of a military person in a life threatening situation. The same problem would exist for police officers or swat team members that use the pump action shotgun. The prolonged period for reloading the shotgun also affects skeet shooters when competing in competitions.

It is an object of the invention to provide a novel pump action shotgun that is capable of operating with a shotgun shell magazine that can be quickly and easily attached and removed from the shotgun.

It is also an object of the invention to provide a novel method of modifying existing pump action shotguns so that they will be capable of functioning with a quickly attachable and detachable shotgun shell magazine.

It is another object of the invention to provide a novel pump action shotgun that can be converted to a magazine loaded weapon with a minimum amount of cost to its owner.

It is a further object of the invention to provide a method for modifying a pump action shotgun so that it can be magazine loaded with minimal changes to existing shotguns.

SUMMARY OF THE INVENTION

The invention relates to pump action shotguns and it involves structure that can be used to create a magazine loaded pump action shotgun. The novel structure can be incorporated into existing pump action shotguns by doing minimal modification of existing structure or by use of a retro-fit kit. The novel structure can also be incorporated into new pump action shotguns so that they would be originally manufactured to function with a quickly attachable and detachable shotgun shell magazine.

The modification to an existing pump action shotgun will now be described. The elongated coil magazine spring would be removed from the magazine tube. A shotgun shell loading port would be formed in the bottom surface of the magazine tube adjacent the front end of the receiver. A magazine adapter would be welded on the bottom surface of the magazine tube and it would surround the shotgun shell loading port. The top surface of the magazine tube would also have a longitudinally extending slot formed in its top surface. The forearm would have a transverse bore hole drilled in its top surface adjacent its forward end. An allen screw would be inserted through this bore hole, through the longitudinal slot in the top surface of the magazine tube and screwed into an internally threaded bore hole in the cylindrical head member of the compressible subgroup assembly that would be inserted into the interior of the magazine tube. Thus the reciprocal pump action of the forearm would cause the compressible subassembly to travel rearwardly with the forearm as a single unit and the allen screw would pass along the length of the slot in the top surface of the magazine tube. The bottom surface of the forearm would also have to be relieved so that the forearm can pass the magazine adapter that has been welded onto the bottom surface of the magazine tube.

If a retro-fit kit is used, it would include a new magazine having an elongated slot in its top surface, a shotgun shell loading port, and a magazine adaptor surrounding and extending downwardly from the shotgun shell loading port. Also included would be a forearm such as seen in the drawings and the action slide assembly it mates with. The last major component would be the compressible subgroup assembly.

The manner in which the pump action shotgun functions will now be described. With the forearm in its forward most position, a shotgun shell from the magazine will have been pushed up through the shotgun shell loading port and into the rear of the magazine tube. To load that shell into the receiver and then into the rear of the gun barrel, the forearm would be pulled rearwardly until the transversely extending screw in the forearm abuts the rear of the slot in the top surface of the magazine tube. This will cause the compressible subgroup assembly to travel rearwardly and push the shotgun shell that has been loaded into the magazine tube rearwardly into the receiver. The relieved portions on the bottom surface of the forearm will pass the magazine adapter and allow it to travel to its rearmost position. At that point, the coiled spring within the outer tube member of the subgroup assembly will be compressed and a screw pin passing transversely through the outer tube member will have traveled along the longitudinally extending slot in the connecting member portion of the subgroup assembly. Within the receiver, the shell will have been placed on the elevator structure and lifted upwardly to the rear end of the gunbarrel where it will be positioned. Forward travel of the forearm will pull the compressible subgroup assembly forward and allow its coiled spring to expand. The rear end of the compressible subgroup assembly will clear the front end of the shotgun shell loading port thus allowing a new shotgun shell to be injected into the rear end of the magazine tube. The gun would then be fired and the whole process would be repeated with the forearm being drawn rearwardly.

DESCRIPTION OF THE PREFERRED EMBODIMENT

Figure 1:
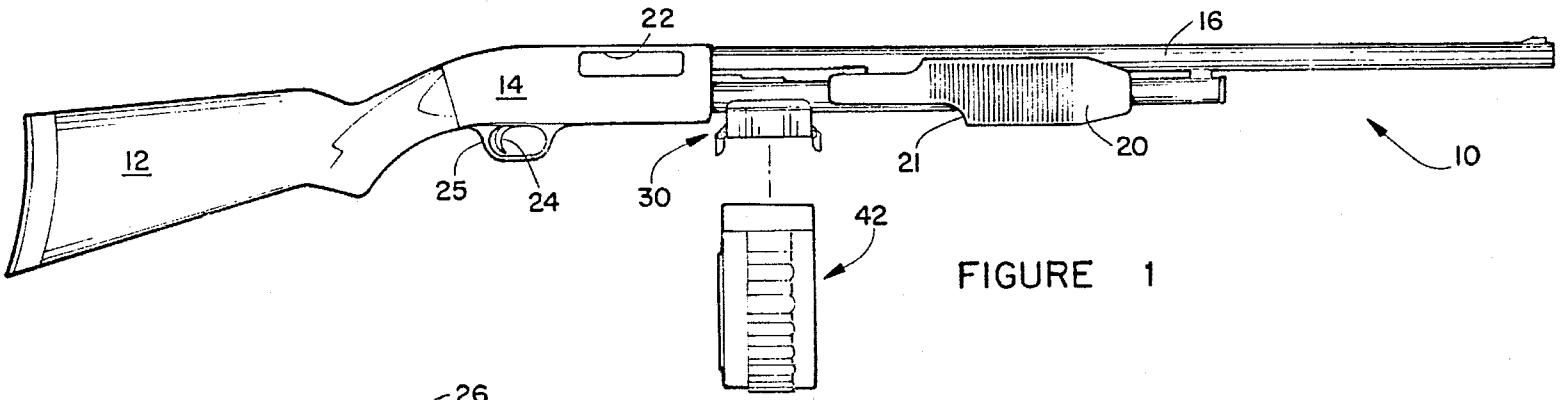
FIG. 1 is a side elevation view of the novel magazine loaded pump action shotgun.
Figure 2:
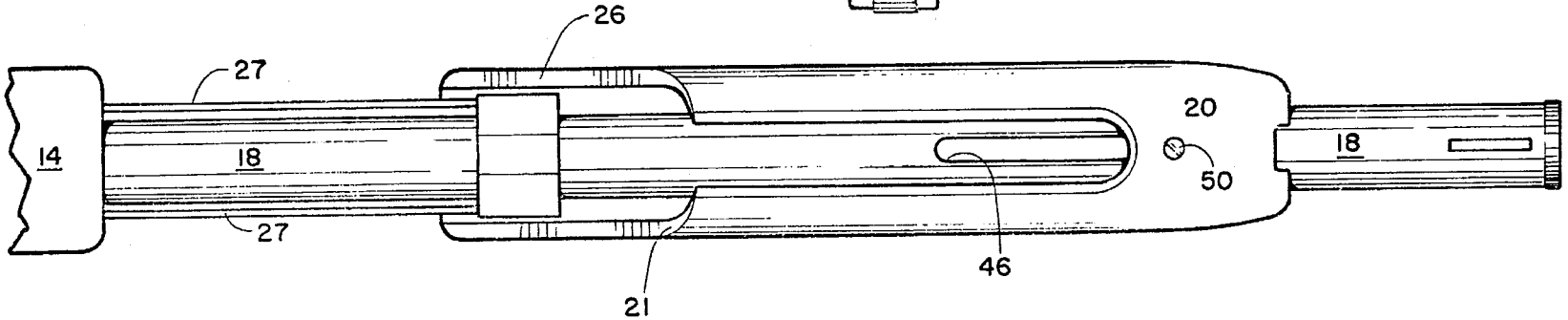
FIG. 2 is a top plan view of the magazine tube and forearm with the gunbarrel removed for clarity.

The novel magazine loaded pump action shotgun will now be described by referring to FIGS. 1–8 of the drawings. The magazine loaded pump action shotgun is generally designated numeral 10.

Pump action shotgun 10 has a stock 12, a receiver 14, a gunbarrel 16, a magazine tube 18 and a forearm 20. Receiver 14 has an ejection port 22, a trigger 24 and a trigger guard 25. Action slide assembly 26 is attached to forearm 20 and it has laterally spaced fingers 27 that travel back into the receiver.

When modifying an existing pump action shotgun most of the existing structure remains intact. An elongated magazine spring is removed from the magazine tube and discarded. A shotgun shell loading port 28 is formed in the bottom surface of magazine tube 18. A magazine adapter 30 is then welded to the bottom surface of magazine tube 18. Magazine adapter 30 has a front wall 32, a rear wall 33, and laterally spaced side walls 34 and 35. A front latching mechanism 38 and a rear latching mechanism 39 on the magazine adapter allow the shotgun shell magazine 42 to be quickly and easily attached and removed. Shotgun shell magazine 42 would have the individual shotgun shells loaded therein and they would be spring loaded to keep pushing a new shotgun shell up through the shotgun loading port 28 once the existing shell has been loaded into the receiver.

The top surface of magazine tube 18 must have a longitudinally extending elongated slot 46 formed in its top surface. The forearm 20 also has to be modified and a bore hole 48 is transversely drilled into its top surface adjacent its front end (see FIG. 3). An allen screw 50 passes through bore hole 48 and is received in an internally threaded bore hole 52 of cylindrical head member 54 of the compressible subgroup assembly 56. Thus forearm 20 and compressible subgroup assembly 56 travel as a single unit when the forearm is pulled rearwardly and pushed forwardly during the pump action.

Figure 3:
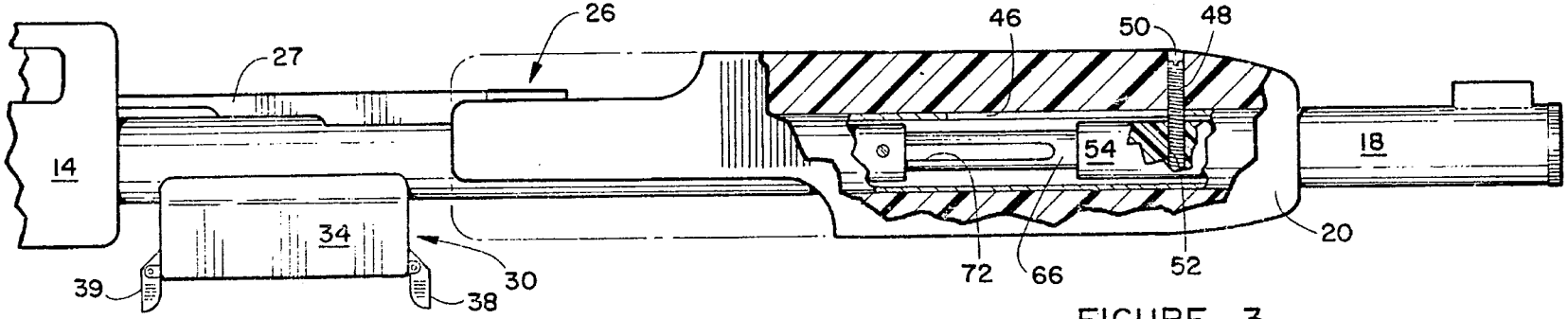
FIG. 3 is a side elevation view of the modified magazine tube and forearm with portions broken away and the gunbarrel removed for clarity.
Figure 4:
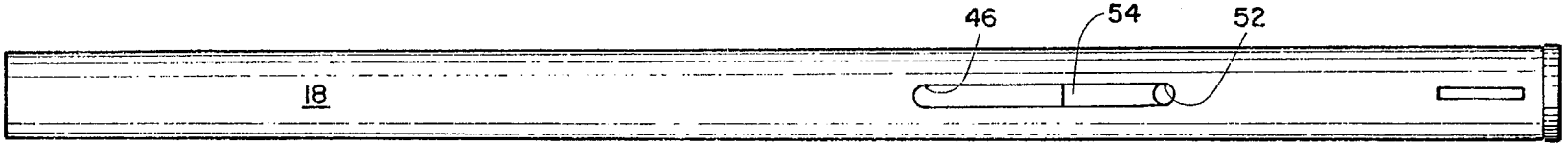
FIG. 4 is a top plan view of the magazine tube.
Figure 5:
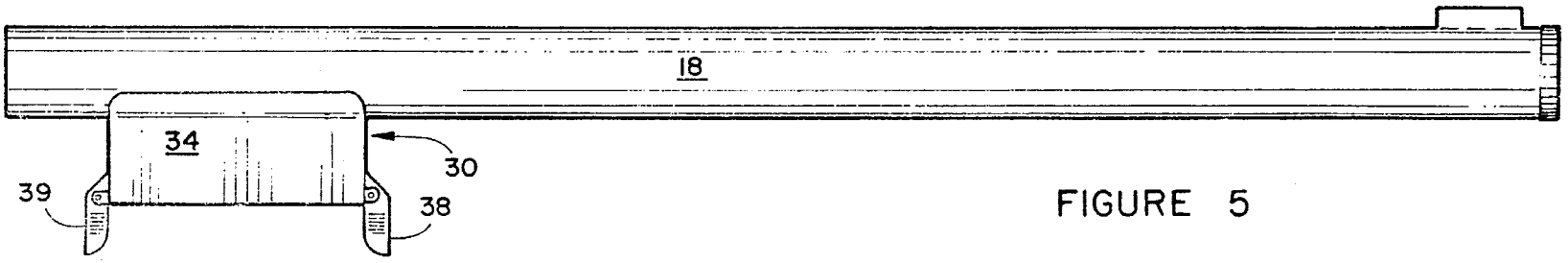
FIG. 5 is a side elevation view of the magazine tube.
Figure 6:
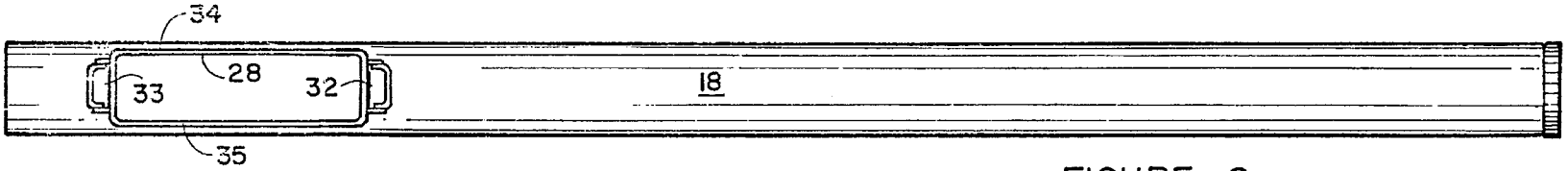
FIG. 6 is a bottom plan view of the magazine tube.
Figure 7:
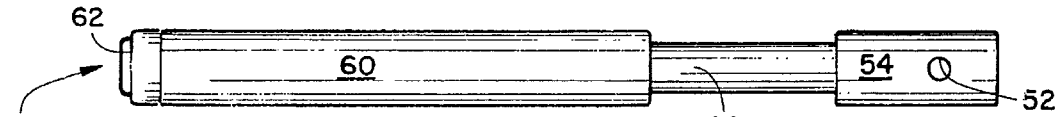
FIG. 7 is a top plan view of the elongated compressible subgroup assembly.
Figure 8:
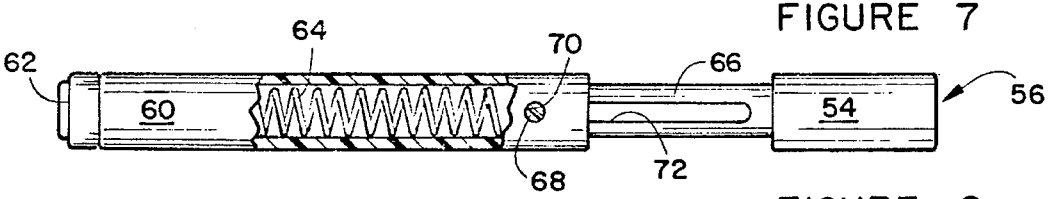
FIG. 8 is a side elevation view of the elongated compressible subgroup assembly with portions broken away.

The compressible subgroup assembly 56 is best illustrated in FIGS. 3, 7 and 8. It has an outer tube member 60 whose rear end is closed by a rear end cap 62. An elongated coil spring 64 is received in the interior of outer tuber member 60. Connecting member 66 is telescopically received in outer member 60 and a screw pin 68 passes through transversely extending bore holes 70 adjacent the front end of outer member 60. Screw pin 68 also passes through elongated slot 72 in the connecting member. A cylindrical head member 54 is formed adjacent the front end of connecting member 56 and its manner of connection to the forearm 20 has been previously described. Forearm 20 has a relieved portion 21 on its bottom surface adjacent its rear end so that it can clear the magazine adapter 30 as forearm 20 is pulled rearwardly.

If a retro-fit kit is used, it would include a new magazine having an elongated slot in its top surface, a shotgun shell loading port, and a magazine adaptor surrounding and extending downwardly from the shotgun shell loading port. Also included would be a forearm such as seen in the drawings and the action slide assembly it mates with. The last major component would be the compressible subgroup assembly.

What is claimed is:

1. A magazine loaded pump action shotgun comprising:

a receiver having a front end and a rear end;

a stock attached to the rear end of said receiver;

an elongated gun barrel having a rear end that is connected to the front end of said receiver;

an elongated magazine tube having a front end, a rear end, a top surface and a bottom surface; the rear end of said magazine tube being connected to the front end of said receiver at a position beneath said gun barrel;

a shotgun shell loading port on the bottom surface of said magazine tube adjacent its rear end;

means adjacent said shotgun shell loading port for detachably securing a magazine filled with shotgun shells to the bottom surface of said magazine tube;

a forearm reciprocally mounted on said magazine tube for ejecting a spent shotgun shell from said receiver and loading a new shell into said receiver from a shotgun shell magazine;

an elongated compressible subgroup assembly removably mounted in said magazine tube, said subgroup assembly having a front end and a rear end, said subassembly being capable of traveling from a forward position that uncovers said shotgun shell loading port to a rearward position that covers said shotgun shell loading port;

means for fixedly securing said forearm to said subgroup assembly so that they reciprocate as a single unit; and said subgroup assembly comprises an elongated outer tube member closed at its rear end by a rear cap and its front end is open and it has an elongated coil spring positioned therein; an elongated connecting member having a front end and a rear end and its rear end is telescopically received in the open end of said outer tube member and positioned against said coiled spring; means for securing said connecting member to said outer tube member; a head member formed on the front end of said connecting member.

2. A magazine loaded pump action shotgun as recited in claim 1 wherein said means for securing said connecting member to said outer tube member comprises said connecting member having an elongated slot, a pin passing through said slot and said pin having a front end and a rear end and they are removably received in a transversely extending bore hole adjacent the front end of said outer tube member.

3. A magazine loaded pump action shotgun as recited in claim 1 wherein said means fixedly securing said forearm to said subgroup assembly comprises a transversely extending bore hole in said forearm adjacent its front end that aligns with a transversely extending threaded bore hole in the head member of said connecting member and a screw removably received in said aligned bore holes.

4. A magazine loaded pump action shotgun as recited in claim 3 further comprising an elongated slot in the top surface of said magazine tube and said screw passes through said slot which is between said forearm and the head member of said connecting member.

5. A magazine loaded pump action shotgun comprising:

a receiver having a front end and a rear end;

a stock attached to the rear end of said receiver;

an elongated gun barrel having a rear end that is connected to the front end of said receiver;

an elongated magazine tube having a front end, a rear end, a top surface and a bottom surface; the rear end of said magazine tube being connected to the front end of said receiver at a position beneath said gun barrel;

a shotgun shell loading port on the bottom surface of said magazine tube adjacent its rear end;

means adjacent said shotgun shell loading port for detachably securing a magazine filled with shotgun shells to the bottom surface of said magazine tube;

a forearm reciprocally mounted on said magazine tube for ejecting a spent shotgun shell from said receiver and loading a new shell into said receiver from a shotgun shell magazine;

an elongated compressible subgroup assembly removably mounted in said magazine tube, said subgroup assembly having a front end and a rear end, said subassembly being capable of traveling from a forward position that uncovers said shotgun shell loading port to a rearward position that covers said shotgun shell loading port;

means for fixedly securing said forearm to said subgroup assembly so that they reciprocate as a single unit; and said forearm having a front end, a rear end, and a bottom surface; the bottom surface of said forearm having a relieved portion adjacent its rear end so that it can clear the means adjacent said shotgun shell loading port for detachably securing the magazine filled with shotgun shells to the bottom surface of said magazine tube.

6. A kit for converting a pump action shotgun to a magazine loaded pump action shotgun comprising:

an elongated magazine tube having a front end, a rear end, a top surface and a bottom surface; a shotgun shell loading port on the bottom surface of said magazine tube adjacent its rear end; means adjacent said shotgun shell loading port detachably securing a magazine filled with shotgun shells to the bottom surface of said magazine tube;

an elongated compressible subgroup assembly for removably mounting in said magazine tube, said subgroup assembly having a front end and a rear end, said subassembly being capable of traveling from a forward position that uncovers said shotgun shell loading port to a rearward position that covers said shotgun shell loading port; said subgroup assembly comprising: an elongated outer tube member closed at its rear end by a rear cap and its front end is open and it has an elongated coil spring positioned therein; an elongated connecting member having a front end and a rear end and its rear end is telescopically received in the open end of said outer tube member and positioned against said coiled spring; means for securing said connecting member to said outer tube; a head member formed on the front end of said connecting member;

a forearm for reciprocally mounting on said magazine tube for ejecting a spent shotgun shell from the receiver of a shotgun and loading a new shell into the receiver from a shotgun shell magazine; and means for securing said forearm to the front of said compressible subgroup assembly.

* * * * *